United States Patent [19]

Shimoma et al.

[11] Patent Number: 4,723,094

[45] Date of Patent: Feb. 2, 1988

[54] COLOR PICTURE DEVICE HAVING MAGNETIC POLE PIECES

[75] Inventors: Taketoshi Shimoma, Isesaki; Kumio Fukuda; Kazuyuki Seino, both of Fukaya, all of Japan

[73] Assignee: Kabushiki Kaisha Toshiba, Kawasaki, Japan

[21] Appl. No.: 769,344

[22] Filed: Aug. 26, 1985

[30] Foreign Application Priority Data

Aug. 27, 1984 [JP] Japan ..... 59-176585

[51] Int. Cl.[4] ..... H01J 29/64

[52] U.S. Cl. ..... 313/412; 313/431

[58] Field of Search ..... 313/412, 413, 414, 431

[56] References Cited

U.S. PATENT DOCUMENTS

| | | | |
|---|---|---|---|
| 3,525,892 | 8/1970 | Javorik et al. | 313/412 |
| 3,916,244 | 10/1975 | Evans, Jr. | 313/412 |

FOREIGN PATENT DOCUMENTS

| | | | |
|---|---|---|---|
| 2156905 | 5/1972 | Fed. Rep. of Germany . | |
| 2505977 | 8/1975 | Fed. Rep. of Germany . | |
| 46-25577 | 7/1971 | Japan . | |
| 55-83135 | 6/1980 | Japan . | |
| 57-126047 | 6/1982 | Japan | 313/412 |

OTHER PUBLICATIONS

Patent Abstracts of Japan, unexamined application, E. Section, vol. 4, No. 130, Sep. 12, 1980.

*Primary Examiner*—David K. Moore
*Assistant Examiner*—Sandra L. O'Shea
*Attorney, Agent, or Firm*—Cushman, Darby & Cushman

[57] ABSTRACT

In a color picture device having a color picture tube, three electron guns for emitting electron beams are arranged in a neck section of the tube. A shadow mask, having a number of apertures, is arranged opposing a phosphor screen of a panel section of the tube. Convergence yokes for correcting misconvergence of the three electron beams are arranged around the neck section. A convergence electrode for converging the three electron beams over the entire screen is arranged in the neck section at the ends of the guns closer to the phosphor screen. The convergence electrode has three pairs of pole pieces each of which is formed of a magnetic substance with high permeability and is arranged in the neck section so as to surround the electron beam between the pole pieces. The length Wp of each pole piece along the tube axis is about two times or more the distance G between the pole pieces, and the length Wp is about twice the thickness Wy of the convergence yoke along the tube axis. Thus, the leakage flux from the pair of pole pieces along the tube axis is 20% or less of the total magnetic field generated by the convergence yoke.

2 Claims, 6 Drawing Figures

COLOR PICTURE DEVICE HAVING MAGNETIC POLE PIECES

BACKGROUND OF THE INVENTION

The present invention relates to a color picture device and, more particularly, to an improvement in a convergence device for performing convergence correction of three electron beams emitted from an electron gun assembly having a delta arrangement.

A color picture device of the type mentioned above is described in, for example, Japanese Patent Publication No. 25577/1971. This color picture device comprises an envelope having a neck section, a funnel section and a glass panel section with a phosphor screen. Electron guns are arranged in a delta form in the neck section, and emit three electron beams of red, green and blue. The centers of these electron guns define vertices of a regular triangle, and one vertex defines the vertical axis of the faceplate of the glass panel section. The electron beams emitted from the electron guns are respectively converged to a predetermined aperture in a shadow mask by electron lenses consisting of a plurality of grid electrodes and a common convergence electrode mounted on the distal ends of the three electron guns. A pair of substantially parallel pole pieces are arranged in the convergence electrode so as to surround each corresponding electron beam. The three electron beams passing through the aperture land on R, G and B phosphor dots on the phosphor screen formed on the inner surface of the faceplate of the glass panel, so that the phosphor dots emit light of the corresponding color.

In order to display a clear image on the phosphor screen, the respective electron beams must land on the corresponding phosphor dots on the entire screen, and the three electron beams must be correctly converged on the phosphor screen so as to prevent color misregistration. Various parts are arranged around the envelope so as to prevent a convergence error. Blue lateral magnet, purity magnets, convergence yokes, and deflection yokes are arranged around the neck section sequentially in the propagation direction of the beams. First, convergence of R, G and B beams on the screen is corrected in the radial direction by stick magnets assembled in the convergence yokes. Second, convergence is corrected by the blue lateral magnet in the horizontal direction of the blue beam. The purity magnets adjust the deflection center of the three electron beams so as to improve color purity. The convergence yokes are arranged around the neck section so as to oppose pairs of pole pieces of the convergence electrode. The convergence yokes serve to correct a convergence error which is caused when the electron beams are deflected at the center of the screen by the deflection yokes.

The function of the convergence yokes and pole pieces for the electron beams will be described below. Lines of magnetic force generated from one magnetic pole (N pole) of the convergence yoke are absorbed by the wide magnetic field absorption portion of the pole piece and are guided therethrough to the end portion of the pole piece. The distance between the end portions of the pair of pole pieces is kept substantially constant, so that the magnetic field generated between the end portions of the pair of the pole pieces by the corresponding convergence yoke is uniform. The magnetic path returning to the other magnetic pole (S pole) of the convergence yoke is in adverse order of that described above. The magnetic field of the convergence yoke which is generated between the end portions of the pair of pole pieces provides a slight deflection to the electron beam in the radial direction of the neck. The amounts of the slight deflection in the vertical and horizontal directions is controlled in synchronism with the vertical and horizontal deflections, respectively. Voltages are applied to the vertical and horizontal convergence coils to optimally converge R, G and B beams. In this manner, the convergence yokes correct misconvergence occurring at the peripheral portion of the screen.

However, such a color picture device cannot be used in a display device requiring high precision, e.g., for a high-precision character or graphic display device or for a high-quality TV display. In such a display device, the spot diameter of an electron beam converged on the phosphor screen must be reduced in order to obtain high resolution and sharpness. In order to reduce the spot diameter of the electron beam, the diameter of the electron lens must be increased and magnification M of the lens must be reduced. In this case, the diameter of the electron beam which passes through the electron lens and becomes incident on the convergence electrode increases with the degree being inversely proportional to the magnification M of the electron lens. Therefore, the distance between the pair of pole pieces must be increased in accordance with the diameter of the electron beam. When the pole piece distance is increased, sensitivity of the convergence yoke is degraded. In addition, when misconvergence in the peripheral portion of the screen is corrected by the convergence yoke, the beam on the screen is distorted so that the convergence correction direction coincides with the major axis of the beam spot. The distortion amount, i.e., the ratio of the major axis to the minor axis of the beam spot is proportional to the convergence correction amount by the convergence yoke. According to an experiment, even if the magnetic field generated between the pair of pole pieces has a uniform shape, the beam spot is distorted on the screen due to the edge effect of the magnetic field. Therefore, although the diameter of electron lens increases and the resolution is improved at the center of the screen, resolution near the peripheral portion of the screen is significantly degraded.

SUMMARY OF THE INVENTION

It is an object of the present invention to provide a color picture device which is free from the conventional problems and which has electron guns having electron lenses of large diameter and a convergence device for optimally performing convergence correction.

According to the present invention, the color picture device comprises a vacuum envelope having a tube axis and including a panel section with a phosphor screen on its inner surface, a funnel section and a neck section, and three electron guns arranged in the neck section to emit electron beams. A shadow mask is arranged opposing the phosphor screen of the panel section. The shadow mask has a number of apertures which are regularly arranged so as to selectively allow landing of three electron beams emitted from the electron guns onto predetermined positions on the screen. Convergence yokes for correcting misconvergence of the three electron beams are arranged around the neck section. A convergence electrode for converging the three electron beams over the entire screen is arranged in the neck section at the ends of the guns closer to the phosphor screen. The convergence electrode has three pairs of pole pieces each of which is formed of a magnetic substance with high permeability and is arranged in the neck section so as to surround each corresponding electron beam between the pole pieces. When the distance between the pair of pole pieces is represented by G and the length and thickness of the pole pieces and convergence yokes along the tube axis are represented by Wp and Wy, respectively, the length Wp of each pole piece along the tube axis is about two or more times the distance G between the pole pieces, and the length Wp is about twice the thickness Wy of the convergence yoke along the tube axis. Thus, the leakage flux from the pair of pole pieces along the tube axis is 20% or less of the total magnetic field generated by the convergence yoke.

With the above structure, when electron guns having a beam spot about ½ of the conventional beam spot are combined with the convergence electrode of the present invention, the color picture device of the present invention is less prone to focusing degradation in the peripheral portion of the screen and has a significantly improved resolution over the entire screen.

DETAILED DESCRIPTION OF THE PREFERRED EMBODIMENTS

A color picture device having three electron guns arranged in a delta configuration according to an embodiment of the present invention will be described with reference to FIGS. 1 to 4.

Figure 1:
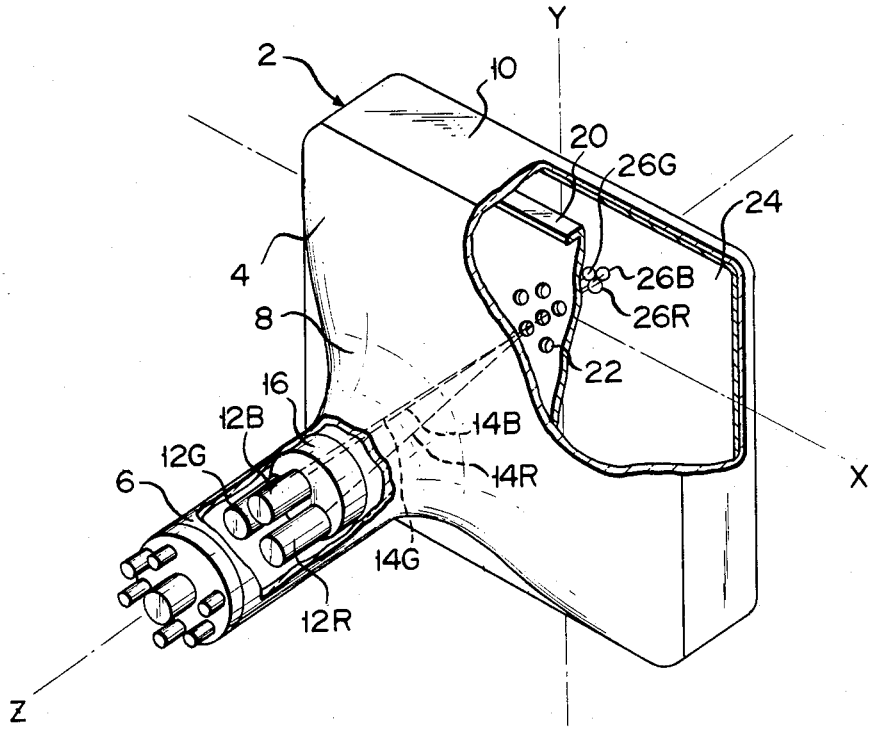
FIG. 1 is a schematic perspective view of a color picture device according to the present invention with a part thereof being shown in section.

FIG. 1 shows a color picture tube 2 used in this color picture device. As shown in FIG. 1, the color picture tube 2 has a tube axis direction Z. The horizontal and vertical directions X and Y are perpendicular to each other in a plane perpendicular to the tube axis Z. The tube 2 has a vacuum envelope 4. The envelope 4 has a neck section 6, a conical funnel section 8 contiguous with the neck section 4, and a glass panel section 10 having a skirt portion contiguous with the funnel section 8 and a substantially rectangular faceplate portion.

Electron guns 12R, 12G and 12B for emitting three electron beams 14R, 14G and 14B are arranged in the neck section 2. As shown in FIG. 1, the guns 12R, 12G and 12B are arranged on the vertices of a regular triangle which has the center of gravity coinciding with the tube axis Z, one vertex on the vertical direction Y, and one side which is opposite to the one vertex along the vertical direction Y and perpendicular to the vertical direction Y. Each of the guns 12R, 12G and 12B has a cathode assembly (not shown) and first to fourth grid electrodes. Electron lenses constituted by these grid electrodes, particularly, one formed between the third and fourth electrodes have a large diameter. A common convergence electrode 16 is mounted on the ends of the guns 12R, 12G and 12B. As will be described with reference to FIGS. 3 and 4, a pair of pole pieces 18 of a magnetic substance having a high permeability are mounted on the convergence electrode 16 so as to embrace each corresponding beam 14R, 14G or 14B.

A shadow mask 20 is arranged inside the glass panel section 10 of the envelope 2 at the side closer to the faceplate. A number of apertures 22, being in a regular array, for passing the electron beams 14R, 14G and 14B from the electron guns 12R, 12G and 12B are formed in the shadow mask 20. A phosphor screen 24 is formed on the inner surface of the faceplate of the glass panel section 10. A number of phosphor trios 26R, 26G and 26B for emitting red, green and blue light are formed on the screen 24. The trios 26R, 26G, and 26B are arranged on lines which connect the guns 12R, 12G and 12B and the aperture 22 of the shadow mask 20, respectively.

Figure 2:
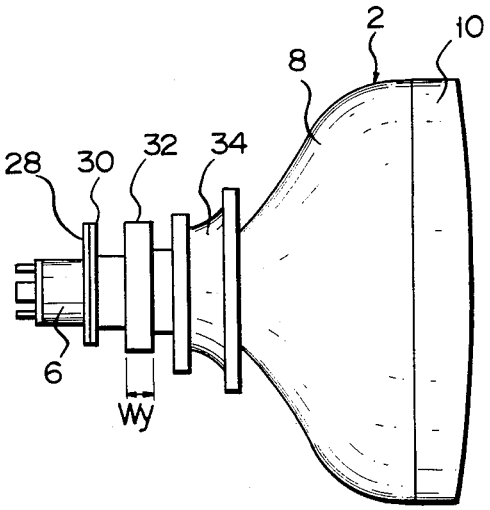
FIG. 2 is a side view of the color picture device shown in FIG. 1 wherein various electron beam adjusting devices are arranged around the neck section.

Electron beam adjustment devices as shown in FIG. 2 is added so as to allow the electron beams 14R, 14G and 14B to land on predetermined trios 26R, 26G and 26B.

Figure 3:
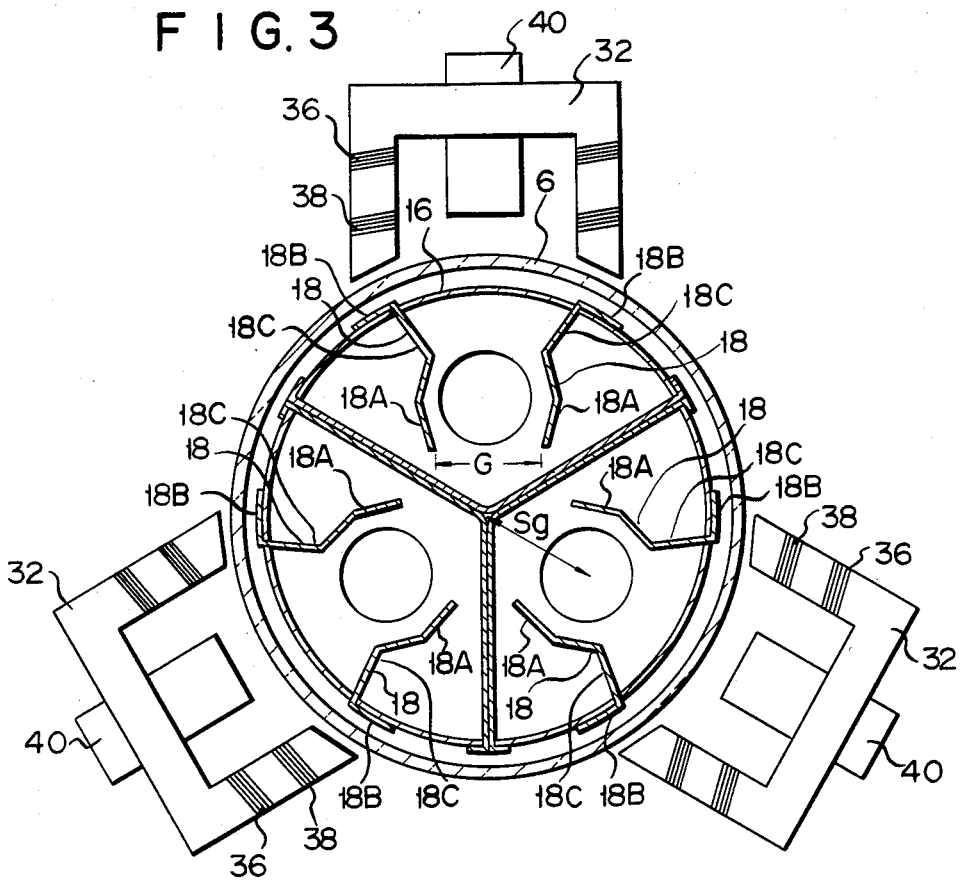
FIG. 3 is a sectional view of convergence yokes at the neck section of the color picture device shown in FIG. 1.

As shown in FIG. 2, a blue lateral magnet 28, purity magnets 30, convergence yokes 32, and deflection yokes 34 are arranged around the small-diameter neck section 6 sequentially along the propagation direction of the electron beams. The blue lateral magnet 28, the purity magnets 30 and the convergence yokes 32 serve to correct deflection deviation of the electron beams 14R, 14G and 14B due to various errors during manufacture of the color picture tube. The blue lateral magnet 28 is arranged around the second grid electrode and adjust the relative position of the blue electron beam 14B with reference to the red and green electron beams 14R and 14G. The purity magnets 30 are arranged around the third grid electrodes and adjust the deflection center of the three electron beams 14R, 14G and 14B, thereby improving color purity. As shown in FIG. 3, the convergence yokes 32 are arranged around the convergence electrode 16, and each convergence yoke 32 has vertical dynamic coils 36, horizontal dynamic coils 38, and a static convergence magnet 40. Each convergence yoke 32 corrects the corresponding electron beam 14R, 14G or 14B. Thus, the convergence yokes 32 serve to adjust the beams 14R, 14G and 14B so that the beams cross at the predetermined aperture 22 of the shadow mask 20.

The deflection yokes 34 are arranged around the neck and funnel sections 6 and 8 of the envelope 2. The deflection yokes 34 correct misconvergence caused when the beams 14R, 14G and 14B are deflected toward the peripheral portion of the screen.

Figure 4:
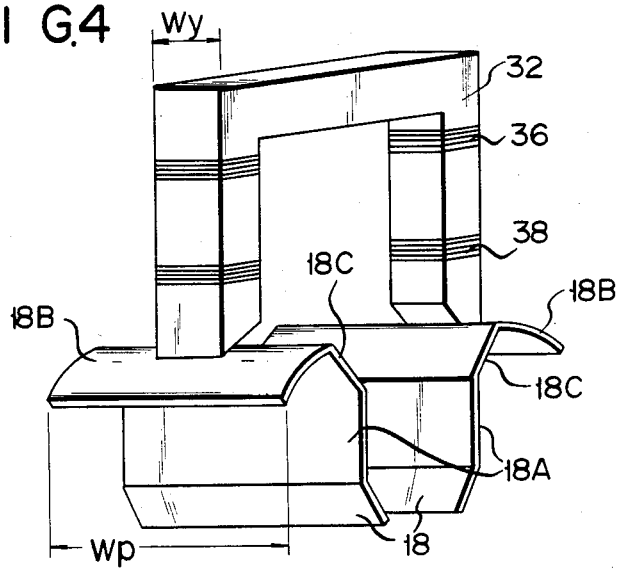
FIG. 4 is a perspective view showing the relative positions of pole pieces and convergence yokes shown in FIG. 3.

As shown in FIGS. 3 and 4, pairs of pole pieces 18 are mounted on the convergence electrode 16. Each pair of pole pieces 18 is arranged to surround the corresponding beam 14R, 14G or 14B along a direction perpendicular to the tube axis and to render the magnetic field in the passing region of the corresponding beam substantially uniform. Thus, each pole piece 18 has an end portion 18A which is bent such that it encircles the corresponding beam 14R, 14G or 14B, a magnetic field absorption portion 18B for absorbing the magnetic field generated by the corresponding convergence yoke 32, and a magnetic field guiding portion 18C for guiding the magnetic field absored by the magnetic field absorption portion 18B to the end portion 18A. The magnetic field absorption portion 18B is mounted on the convergence electrode 16. Each pair of pole pieces 18 has a wide distance for surrounding the corresponding beam 14R, 14G or 14B.

As shown in FIG. 4, a distance G between the end portions 18A of each pair of the pole pieces 18 is substantially equal to a distance Sg between the tube axis Z and the center of the electron beam. A length Wp of each pair of pole pieces 18 along the tube axis Z is set to be about three times that of the distance G between the end portions 18A of each pair of pole pieces 18. A thickness Wy of the convergence yokes 32 along the tube axis is about ½ the length of the pole pieces 18 along the tube axis Z. The center position between the pole pieces 18 along the tube axis Z coincides with the center of the corresponding convergence yoke 32 along the tube axis Z.

In order to allow independent correction of the three beams 14R, 14G and 14B, each of the convergence yokes 32 comprises an independent cores and two pairs of coils wound around the core, that is to say, vertical and horizontal coils 36 and 38. The distal ends of the cores of each convergence yoke 32 oppose the magnetic field absorption portions 18B of the corresponding pole pieces 18. Magnetic fields of predetermined intensity synchronised with horizontal and vertical deflection, respectively, are applied to the coils 36 and 38. A uniform magnetic field is formed between the end portions 18A of the pole pieces 18 of each pair. Lines of magnetic force of this magnetic field are substantially parallel to each other between the end portions 18A of the corresponding pole pieces 18.

The present inventors have considered the shape of the pole pieces 18 from the shape of the effective beam spot on the screen. A magnetic reluctance Rmg between the end portions 18A of the pole pieces 18 surrounding the electron beam 14R, 14G or 14B is given by:

$$Rmg = kG/(Wp/Wy) \quad (1)$$

where k is a constant, and G, Wp and Wy are respectively the distance between the end portions 18A of each pair of pole pieces 18, the length of the pole pieces 18 along the tube axis Z, and the thickness of the convergence yoke 32 along the tube axis, as described above. As can be seen from equation (1), the magnetic reluctance Rmg increases upon an increase in the distance G between the end portions 18A of each pair of pole pieces 18 or a decrease in the ratio Wp/Wy of the length of the pole pieces 18 to the thickness of the convergence yokes 32.

Figure 5:
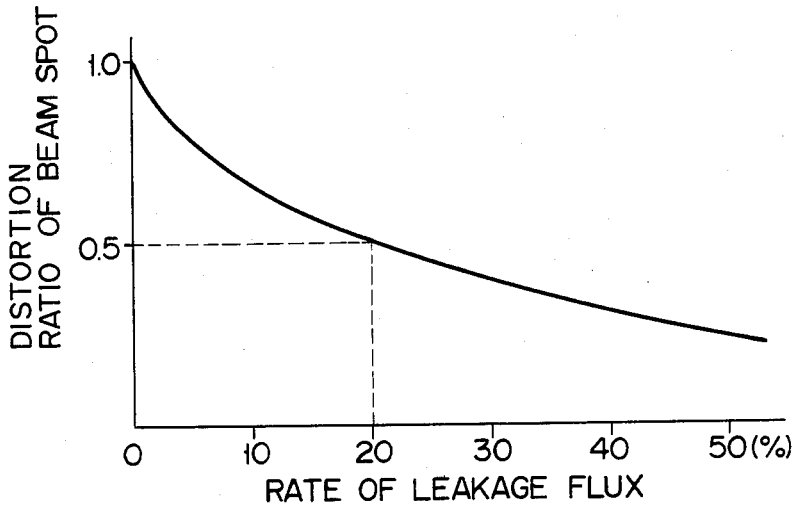
FIG. 5 is a graph showing the relationship between the distortion ratio of a beam spot on the screen and the rate of leakage flux from the pole pieces shown in FIGS. 3 and 4.

FIG. 5 shows the relationship between the distortion ratio of beam spot b/a of the beam 14R, 14G or 14B landing on the screen 24 and the rate of leakage flux from the pole pieces 18 where a is the diameter of the beam 14R, 14G or 14B along the horizontal direction and b is the diameter thereof along the vertical direction. When misconvergence in the peripheral portion of the screen 24 is corrected by the convergence yoke 32, the beam spot of the beam 14R, 14G or 14B is distorted in an elliptical shape wherein the convergence correction direction, that is to say, the progressting direction of the electron beams coincides with its major axis. This distortion ratio b/a of beam spot is proportional to the convergence correction amount by the convergence yoke 32. When the distortion ratio b/a is 1, the shape of the spot of the electron beam 14R, 14G or 14B is circular. In this state, the magnetic field generated by the convergence yoke 32 does not leak through the pole pieces 18. When the distortion ratio b/a exceeds 0.5, the resolution on the screen 24 is greatly impaired. In this case, the rate of leakage flux to the total amount of flux generated is about 20%. When the rate of the leakage flux exceeds 20%, the ratio b/a exceeds 0.5 and is impractical.

Figure 6:
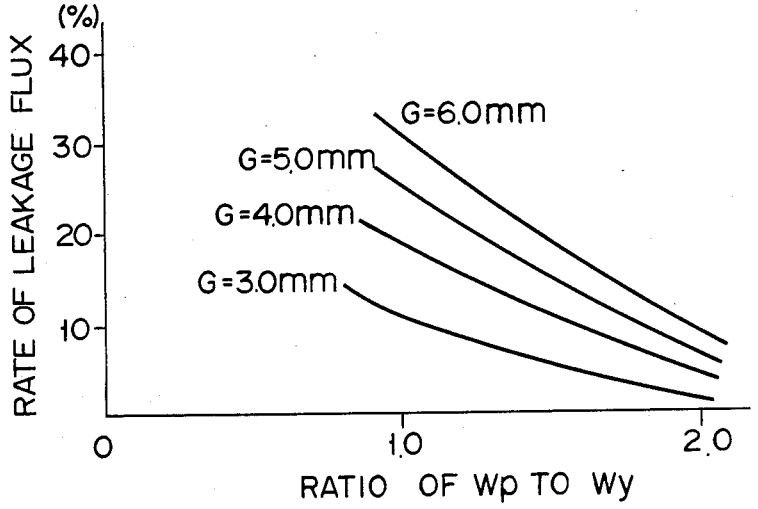
FIG. 6 is a graph showing the relationship between the rate of leakage flux and the ratio of the length of the pole piece along the tube axis to the thickness the convergence yoke using the distance between a pair of pole pieces as a parameter.

FIG. 6 shows solid curves representing the relationship between the ratio of leakage flux from the pole pieces 18 and the ratio of the length of the pole pieces 18 to the thickness of the convergence yoke 32 along the tube axis Z using the distance G between the end portions 18A of each pair of pole pieces as a parameter. The results shown in FIG. 6 were obtained experimentally. As shown in FIG. 6, when the distance G is 6.0 mm, in order to suppress the ratio of leakage flux below 20%, it is sufficient to keep the ratio of the length of the pole pieces 18 to the thickness of the convergence yoke 32 along the tube axis Z to 2 or more.

Particular specifications of the device in this embodiment will be given below. In a 20 inches color picture tube, having a neck section 6 of 26.5 mm diameter and a deflection angle of 90 degrees, the distance Sg between the center of each electron gun 12R, 12G or 12B and that of the neck section 6 is about 6.7 mm. In this case, the diameter of electron lens can be obtained about 10 mm. And in this case, first, the distance G between the end portions 18A of each pair of pole pieces 18 is set to be 6.0 mm. Second, the length Wp of the pole pieces 18 along the tube axis Z is set to be about 20 mm which is about three times the distance G between the end portion 18A of the pole pieces 18. The thickness Wy of the convergence yoke 32 along the axial direction Z is about 10 mm which is about ½ the length of the pole pieces 18 along the tube axis Z.

In a conventional color picture tube of the type described above, the distance G between the end portions of each pair of pole pieces is about 3 mm. Therefore, in a color picture tube according to the present invention, the distance G between the end portions 18A of each pair of pole pieces 18 can be set to be about twice the conventional value by increasing the diameter of the electron lens for the electron guns 12R, 12G and 12B.

According to the present invention, when a convergence electrode 16 of the present invention is combined with electron guns having a beam spot about ½ that of a conventional beam spot, a color picture device is obtained wherein the focusing degradation in the peripheral portion of the screen is reduced to a minimum and resolution is significantly improved over the entire area of the screen 24.

Although the above description has been made with reference to the case of delta electron guns, the present invention is similarly applicable to a color picture device having in-line electron guns.

What is claimed is:

1. A color picture device comprising:

a vacuum envelope having a tube axis and including a panel section having a phosphor screen on an inner surface thereof, a funnel section and a neck section;

three electron guns for emitting electron beams, arranged in said neck section each gun having an electron lens of large diameter associated therewith;

a shadow mask arranged to oppose said phosphor screen of said panel section and having a number of apertures which are regularly arranged so as to selectively allow the electron beams emitted by said three electron guns to land at predetermined positions on said phosphor screen;

convergence yokes, arranged around said neck section, for correcting misconvergence of the electron beams; and a convergence electrode, arranged in said neck portion and mounted on ends of said electron guns closer to said phosphor screen, for converging the electron beams over the entire surface of said phosphor screen, said convergence electrode having three pairs of pole pieces each formed of a magnetic substance having high permeability and arranged in said neck section to surround each corresponding electron beam, the length Wp of the pair of pole pieces along the tube axis being about two times or more the distance G between the pair of pole pieces, said length Wp being about twice the thickness Wy of said convergence yoke along the tube axis, so that the ratio of leakage flux from said pair of pole pieces along the tube axis to total flux generated by said convergence yoke is 20% or less, wherein each of said pole pieces has, in a section in a radial direction of said neck section, a magnetic field absorption portion for absorbing the magnetic field generated by said convergence yoke, and mounted on said convergence electrode, a magnetic field guiding portion, bent away from said magnetic field absorption portion, and an end portion contiguous with said magnetic field guiding portion for surrounding a corresponding electron beam; and wherein the distance SG between said tube axis and the center of the electron beams is approximately equal to said distance G between the pairs of pole pieces.

2. A device according to claim 1, wherein said three electron guns are arranged in a delta form, and centers of said electron guns are arranged on vertices of a regular triangle having the center of gravity which coincides with the tube axis, one vertex on a vertical axis perpendicular to the tube axis, and one side which is opposite to said one vertex along the vertical axis and perpendicular to the tube axis and the vertical axis.

* * * * *